US005528871A

United States Patent [19]

Brodeur

[11] Patent Number: 5,528,871

[45] Date of Patent: Jun. 25, 1996

[54] SELF-ALIGNING, SELF-INTERLOCKING, AND SELF-RESISTING MODULAR BUILDING STRUCTURE

[76] Inventor: Yvon Brodeur, 31 Bord de l'Eau, Lavaltrie, Québec, Canada, J0K 1H0

[21] Appl. No.: 171,102

[22] Filed: Dec. 21, 1993

[51] Int. Cl.[6] ..... E04B 1/10

[52] U.S. Cl. ..... 52/271; 52/284

[58] Field of Search ..... 52/271, 284

[56] References Cited

U.S. PATENT DOCUMENTS

| | | | |
|---|---|---|---|
| 637,212 | 11/1899 | McCune . | |
| 1,012,185 | 12/1911 | Barton . | |
| 2,099,149 | 11/1937 | Turnquist | 52/271 |
| 2,129,441 | 8/1938 | Otto | 52/271 |
| 2,142,110 | 1/1939 | Calkins et al. | 189/34 |
| 2,328,928 | 9/1943 | Sherron | 180/2 |
| 3,417,530 | 12/1968 | Long | 52/496 |
| 3,608,260 | 9/1971 | Eckel et al. | 52/284 |
| 3,738,083 | 6/1973 | Shimano | 52/271 X |
| 3,783,563 | 1/1974 | Moore | 52/271 X |
| 4,100,711 | 7/1978 | Skuran | 52/489 |
| 4,337,604 | 7/1982 | Bürgers | 52/287 |
| 4,517,232 | 5/1985 | Krauser | 428/57 |
| 4,575,979 | 3/1986 | Mariani | 52/24 |

FOREIGN PATENT DOCUMENTS

| | | | |
|---|---|---|---|
| 529025 | 6/1954 | Belgium . | |
| 569108 | 7/1958 | Belgium . | |
| 582935 | 9/1959 | Canada | 52/271 |
| 1220317 | 4/1987 | Canada . | |
| 1287964 | 8/1991 | Canada . | |
| 75409 | 2/1953 | Denmark . | |
| 820521 | 8/1937 | France . | |
| 1106058 | 5/1961 | Germany | 52/271 |
| 1683307 | 2/1968 | Germany . | |
| 2611451 | 3/1976 | Germany . | |
| 541733 | 12/1941 | United Kingdom . | |
| 825141 | 12/1959 | United Kingdom . | |
| 1181857 | 2/1970 | United Kingdom | 52/271 |

*Primary Examiner*—Carl D. Friedman
*Assistant Examiner*—Kevin D. Wilkens
*Attorney, Agent, or Firm*—Merchant, Gould, Smith, Edell Welter & Schmidt

[57] ABSTRACT

A kit for the construction of a building comprises a series of modular floor units and an elongate aligning member. The modular units are assembled together in a horizontal plane to form a floor and comprise respective elongate border portions disposed end to end in the horizontal plane. Each border portion is formed with a first outer surface lying across the horizontal plane, a first longitudinal tongue substantially parallel to the first surface, and a first longitudinal groove formed between the first tongue and the first surface. The elongate aligning member is formed with a second surface lying across the horizontal plane, a second longitudinal tongue parallel to the second surface and to be received in the first groove, and a second longitudinal groove formed between the second tongue and the second surface to receive the first tongue to thereby align the series of modular floor units in the horizontal plane and prevent these floor units from moving with respect to each other in the horizontal plane. The kit may further comprise a series of modular wall units to be assembled together to form a vertical wall. Border portions of the modular wall units and the elongate member comprise respective, mutually mating interlocking tongues and grooves mating each other to give to the series of modular wall units a given alignment.

7 Claims, 5 Drawing Sheets

SELF-ALIGNING, SELF-INTERLOCKING, AND SELF-RESISTING MODULAR BUILDING STRUCTURE

BACKGROUND OF THE INVENTION

1. Field of the Invention

The present invention relates to a kit to be used in the construction of a building, for example but not exclusively a single-family house.

In the present specification and in the appended claims, the term "wall means" should be interpreted as encompassing floors, ceilings, vertical or inclined wall structures, partitions, roof surfaces, etc.

2. Brief Description of the Prior Art

The prior art is replete with modular kits to be used in constructing a building. Examples are shown in the following two Canadian patents:

| | | |
|---|---|---|
| 1,220,317 | (Mueller et al.) | 1987 |
| 1,287,964 | (Tissington et al.) | 1991 |

OBJECT OF THE INVENTION

An object of the present invention is to improve the construction kits of the prior art by making the building modular structure self-aligning.

Another object of the present invention is to improve the construction kits of the prior art by making the building modular structure self-interlocking and self-resisting.

SUMMARY OF THE INVENTION

More specifically, the present invention provides a kit to be used in the construction of a building, comprising (a) a series of modular units to be assembled together into a given plane to form a wall means, these modular units comprising respective border portions to be disposed end to end in the plane, and (b) an elongate aligning member. The border portions and the elongate member comprise respective first and second mutually mating interlocking means. In accordance with the invention, the first and second interlocking means comprise means for giving to the series of modular units a given alignment in the plane and means for preventing the modular units from moving with respect to each other in that plane.

According to a preferred embodiment of the subject invention, the first interlocking means comprises each border portion formed with a first outer surface lying across the plane, a first tongue substantially parallel to the first surface, and a first groove formed between the first tongue and the first surface, and the second interlocking means comprises the elongate member formed with a second surface lying across the plane, a second tongue generally parallel to the second surface and to be received in the first groove, and a second groove formed between the second tongue and the second surface to receive the first tongue.

The construction kit may further comprise a series of second modular units to be assembled together to form a second wall means angularly disposed with respect to the first one, these second modular units comprising respective second border portions to be disposed end to end. The second border portions and the elongate member comprise respective third and fourth mutually mating interlocking means mating each other to give to the series of second modular units a given alignment.

In accordance with a further preferred embodiment of the construction kit of the invention, the third interlocking means comprises the second border portions formed with respective tongues, and the fourth interlocking means comprises the elongate member formed with a longitudinal groove mating the tongues of the second border portions.

The present invention further relates to a kit to be used for constructing a wall means, comprising a series of modular units to be assembled together into a given plane to form these wall means. Each pair of adjacent modular units comprises respective first and second elongate mutually mating borders to retain the two modular units to each other in the plane. The first border is formed of a first set of superposed strips of board material including (a) a first strip lying across the plane, (b) a second strip mounted on the first strip, and (c) a third strip mounted on the second strip to define a first tongue and a first groove between the first tongue and the first strip. The second border is formed of a second set of superposed strips of board material including (a) a fourth strip lying across the given plane, (b) a fifth strip mounted on the fourth strip, and (c) a sixth strip mounted on the fifth strip to define a second tongue to be received by the first groove and a second groove between the second tongue and the fourth strip to receive the first tongue.

When a load is supported by one of the modular units, flexion of this modular unit produces a pulling force on the other modular units through the mutually mating borders whereby the other modular units contribute to support the load and thereby to increase the rigidity and strength of the wall means.

In accordance with a preferred embodiment, the first, second and third strips form a single piece, and the fourth, fifth and sixth strips also form a single piece.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

The modular units and elongate aligning members of the construction kit in accordance with the present invention can be made of rectangular strips of particle board glued, nailed and/or screwed together. Particle board of ¼–¾ inch thick is suitable for that purpose. Although particle board is suggested as material, it should be kept in mind that the present invention is not limited to this material and that any other suitable material can be contemplated.

Figure 1:
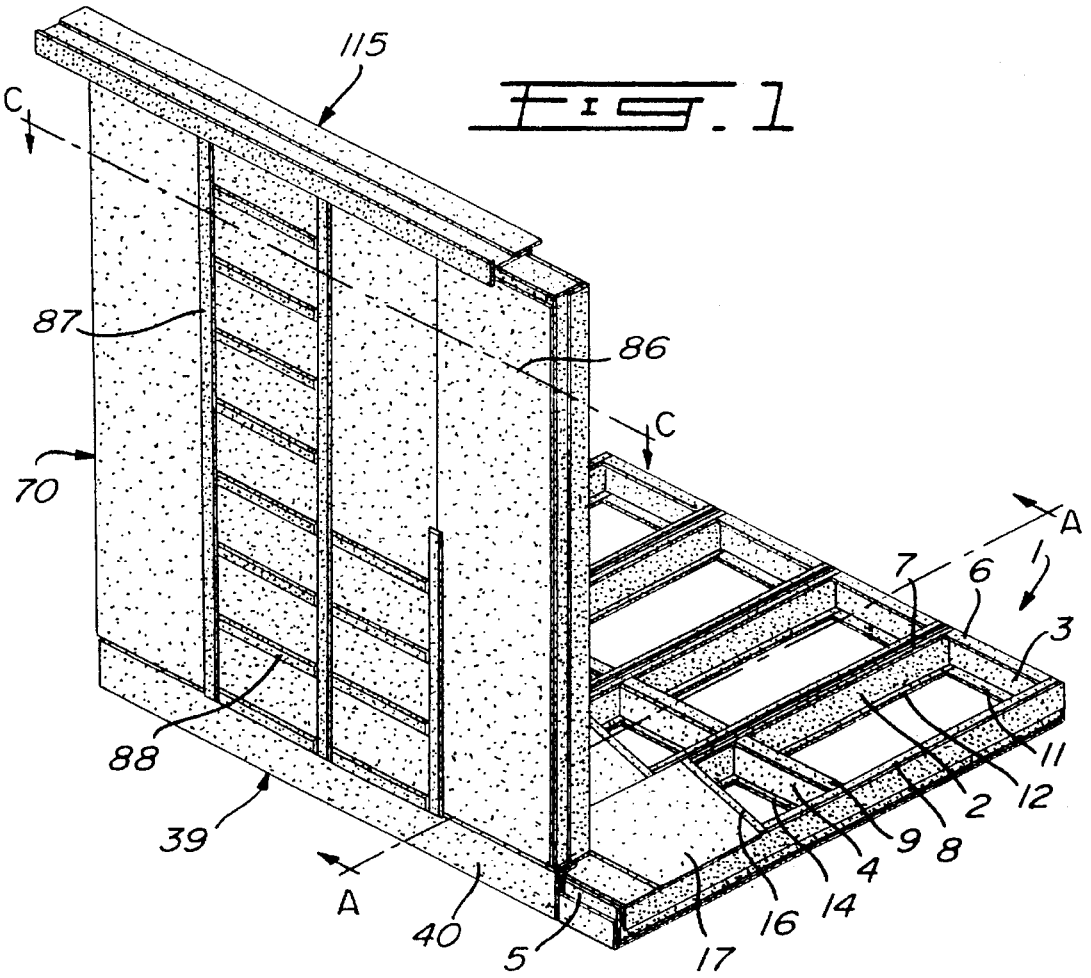
FIG. 1 is a perspective view of a portion of building erected by means of the construction kit in accordance with the present invention.
Figure 3:
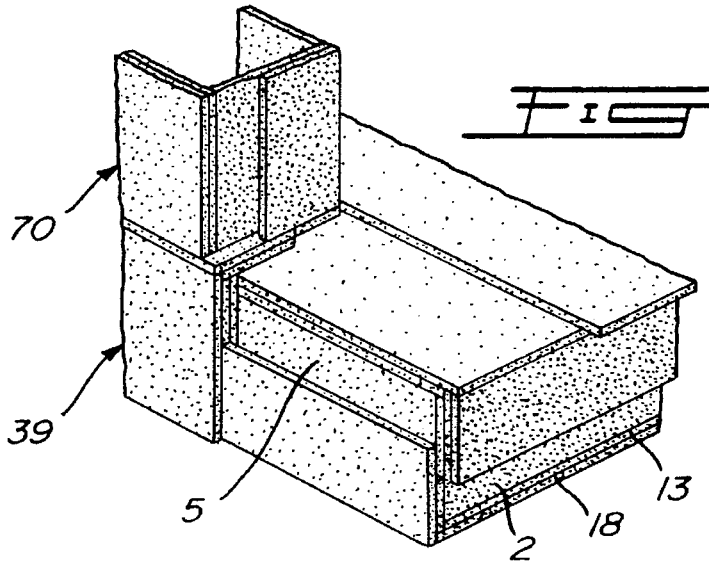
FIG. 3 is a perspective view showing the assembly of modular floor and wall units by means of an elongate aligning member.

The construction kit first comprises elongated modular floor units such as 1. Each modular floor unit 1 is formed, as illustrated in FIGS. 1, 2, 3 and 4, of two longitudinal strips 2 and 2' of particle board, a first end transverse strip 3 of particle board, a central transverse strip 4 of the same material and a second end transverse strip 5. As illustrated in FIG. 1, the strips 2, 2' and 3–5 are arranged to form a rectangular box-like structure.

Secured to the upper edge surfaces of the strips 2, 2' and 3–5 are upper narrow strips 6–10 of particle board. Secured to the lower edge surfaces of the strips 2, 2' and 3–5 are also lower narrow strips 11–15 of particle board. The function of the upper and lower narrow strips 6–15 is to reinforce the rectangular box-like structure and to provide gluing, nailing and/or screwing surfaces.

Two panels 16 and 17 of particle board are then mounted on the upper narrow strips 6–10 to form a top surface capable of receiving a floor covering.

Further strips such as 18 of particle board are secured to the underside of the lower narrow strips 11–15 to provide a surface for nailing the ceiling finishing materials.

As can be seen, the underside of the modular floor units 1 is open, for example to enable installation of insulating material, water pipes, electric wires, etc.

Figure 4:
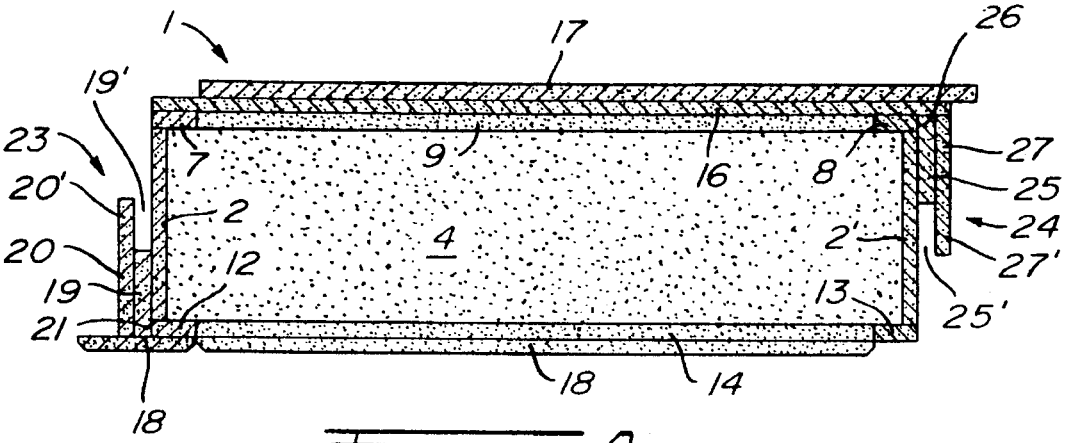
FIG. 4 is a cross sectional elevational view of a modular floor unit of the construction kit of FIGS. 1 and 2, taken along line B—B of FIG. 2.

As illustrated in FIG. 4, a first longitudinal border portion 23 of each modular unit 1 is elongate and comprises a narrow longitudinal strip 19 of particle board fixed to the outer face of the strip 2, and to the outer edge surface 21 of the lower reinforcing strip 12. Another longitudinal strip 20, wider than the strip 19, is superposed to the outer face of strip 19.

The longitudinal border portion 24 of each modular floor unit 1, opposite to border portion 23 is elongate and comprises a narrow longitudinal strip 25 of particle board superposed to the outer face of the strip 2' and to the outer edge surface 26 of the upper reinforcing strip 8. Another longitudinal strip 27, wider than strip 25, is superposed to the outer face of that strip 25.

A longitudinal tongue 20' is formed by the strip 20 and a longitudinal groove 19' is delimited between the tongue 20' and the strip 2. In the same manner, a longitudinal tongue 27' is formed by the strip 27 and a longitudinal groove 25' delimited between the tongue 27' and the strip 2'. The tongue and groove sets 20',19' and 27',25' form first and second mutually mating interlocking means permitting easy assembly of a series of laterally adjacent floor units 1; the groove 19' is adapted to receive the tongue 27' of an adjacent modular floor unit while the tongue 20' will be received by the groove 25' of this adjacent modular floor unit.

As the strips 2, 19, 20 and 2' 25 27 are perpendicular to the horizontal plane of the floor, the grooves 19' and 25' and the tongues 20' and 27' connect the modular units 1 to each other in the horizontal plane to thereby prevent lateral movement of a series of laterally adjacent modular floor units 1 with respect to each other (self-interlocking structure). Therefore, when a load is supported by one of the modular floor units 1, flexion of this modular unit produces a pulling force on the other modular floor units 1 through the mutually mating tongue and grooves sets 20',19' and 27',25' whereby the other modular units 1 will also contribute to support that load and thereby to increase the rigidity and strength of the floor structure (self-resisting structure).

Figure 2:
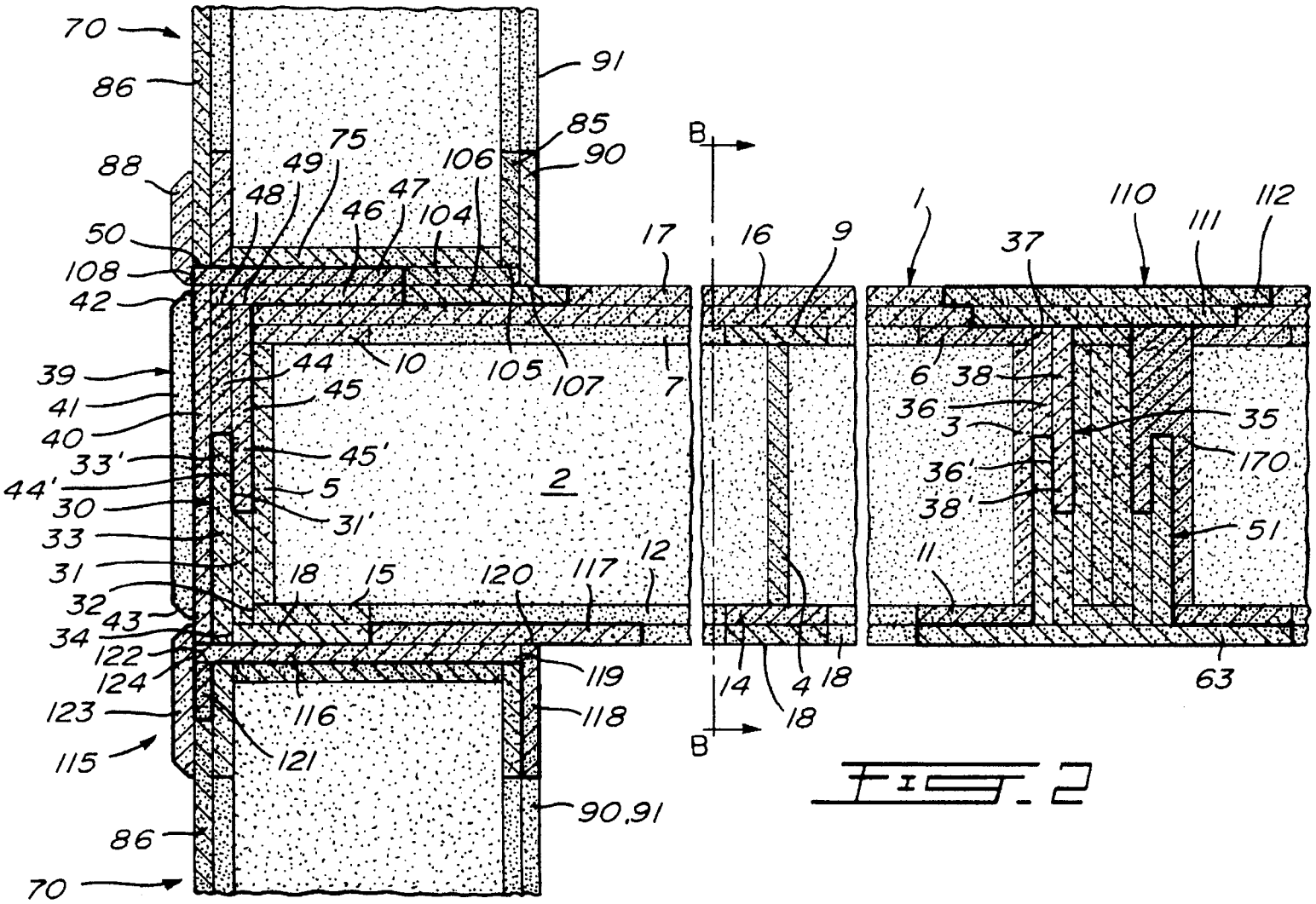
FIG. 2 is a cross sectional elevational view taken along a line such as line A—A of FIG. 1, showing the method of assembling modular floor and wall units and elongate aligning members of the construction kit.

Referring now to FIG. 2, the transverse end border portion 30 of each modular floor unit 1 is elongate and includes a narrow longitudinal strip 31 of particle board superposed to the outer face of strip 5, and to the outer edge surface 32 of the lower reinforcing strip 15. Another longitudinal strip 33, wider than strip 31, is fixed to the outer face of strip 31 and to the edge surface 34 of the adjacent one of the strips 18.

The other transverse end border portion 35 of each modular floor unit 1 is elongate and comprises a narrow longitudinal strip 36 of particle board fixed to the outer face of the strip 3, and to the outer edge surface 37 of the upper reinforcing strip 6. Another longitudinal strip 38, wider than strip 36, is superposed to the outer face of this strip 36.

Therefore, a longitudinal tongue 33' is formed by the strip 33 and a longitudinal groove 31' is delimited between the tongue 33' and the strip 5. In the same manner, a longitudinal tongue 38' is formed by the strip 38 and a longitudinal groove 36' delimited between the tongue 38' and the strip 3. The tongue and groove sets 33',31' and 38',36' form first and second mutually mating interlocking means enabling assembly of floor units 1 end to end; the groove 31' is adapted to receive the tongue 38' of an adjacent modular floor unit 1 while the tongue 33' will be received by the groove 36' of this adjacent modular floor unit.

Again, as the strips 5, 31, 33 and 3, 36, 38 are perpendicular to the horizontal plane of the floor, the grooves 31' and 36' and the tongues 33' and 38' connect the modular units 1 end to end in the horizontal plane to thereby prevent longitudinal movement of a series of modular floor units 1 with respect to each other (self-interlocking structure). Again, when a load is supported by one of the modular floor units 1, flexion of this modular unit produces a pulling force on the other modular floor units 1 through the mutually mating tongue and grooves sets 33',31' and 38',36' whereby the other modular units 1 will also contribute to support that load and thereby to increase the rigidity and strength of the floor structure (self-resisting structure).

In order to align a series of laterally adjacent modular floor units 1 in the horizontal plane of the floor, an elongate aligning member 39 is used. The elongate member 39 first comprises a longitudinal strip 40 of particle board, having a width equal to the thickness of the floor unit 1. Fixed to the outer face of the longitudinal strip 40 are vertical strips such as 41, made of particle board and distributed over the length of the strip 40. Strips 41 provides for exterior nailing of the covering material.

The elongate member 39 further comprises a narrow longitudinal strip 44 of particle board fixed to the upper portion of the inner surface of the strip 40 and another longitudinal strip 45, wider than strip 44, and superposed to that strip 44. The elongate member 39 finally includes longitudinal lower and upper strips 46 and 47. Strip 46 is perpendicular to strips 40, 44 and 45 and is secured to the upper longitudinal edge surfaces 48 and 49 of the strips 44 and 45, respectively, and to the inner surface of the vertical strip 40. Strip 47 is fixed to the top face of the horizontal strip 46 and to the top longitudinal edge surface 50 of the strip 40.

As illustrated in FIG. 2, a longitudinal tongue 45' is formed by the strip 45 of elongate member 39 and a longitudinal groove 44' is delimited between the tongue 45' and the strip 40.

Obviously, the transverse end border portions 30 of a series of laterally adjacent floor unit 1 are disposed end to end in the horizontal plane of the floor. To align this series of laterally adjacent floor units 1 in the horizontal plane, the border portions 30 and the elongate member 39 comprise respective first and second mutually mating interlocking means. The first interlocking means comprises the tongue and groove set 33',31' of the border portions 30 while the second interlocking means comprises the tongue and groove set 45',44'. More specifically, the groove 31' receives the tongue 45' while the tongue 33' is received by the groove 44' to thereby align along a straight line the series of laterally adjacent floor units 1 (self-aligning structure). As the strips 5, 31, 33, 40, 44 and 45 are perpendicular to the horizontal plane of the floor, the first and second interlocking means extend crosswise of the floor whereby mutual mating thereof does not only align the modular units but prevent these modular floor units 1 from moving with respect to each other in the horizontal plane of the floor (self-interlocking structure). It should be noted here that an elongate aligning member such as 39 will be mounted on the four sides of the modular floor structure to improve the rigidify of this floor structure.

Figure 5:
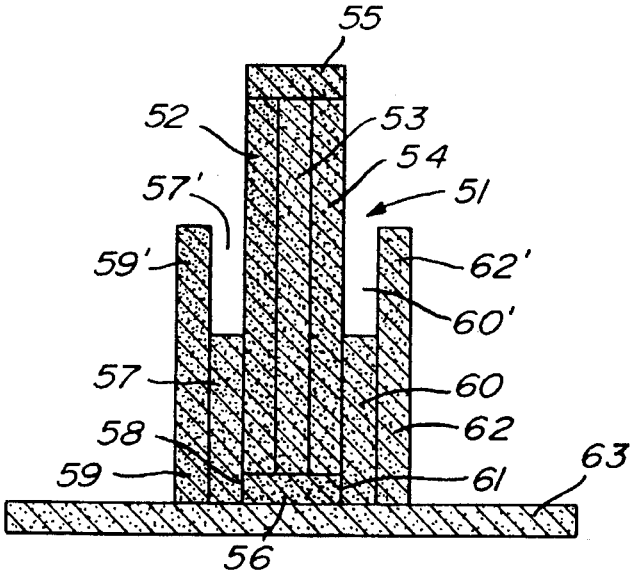
FIG. 5 is a transverse cross sectional elevational view of a girder that can be included in the modular floor structure in accordance with the invention.

Normally, the modular floor units 1 will be mounted onto a supporting structure including the walls of a concrete foundation. However, girders such as 51 (FIG. 2 and 5) may be required to reinforce the floor structure. As illustrated in FIG. 5, the girder 51 includes three elongate parallel superposed strips 52–54 of particle board, of equal width, secured to each other and lying in respective vertical planes. To the top and bottom edge surfaces of the strips 52–54 are secured top and bottom longitudinal narrow strips 55 and 56, having a width equal to the thickness of the three strips 52–54. Another, wider horizontal strip 63 has a top face fixed to the underside of the strip 56.

On a first side of the girder 51 is superposed a narrow longitudinal strip 57 of particle board. More specifically, the strip 57 is secured to the outer face of the strip 52 and to the longitudinal edge surface 58 of the strip 56. As illustrated in FIG. 5, the lower longitudinal edge surface of the strip 57 is coplanar with the underside of the strip 56 and is secured to the top face of the strip 63. A further longitudinal strip 59, wider than strip 57 is fixed to the outer face of this narrow strip 57 with the lower edge surface of the strip 59 applied and secured to the top face of the strip 63.

A longitudinal tongue 59' is formed by the strip 59 and a longitudinal groove 57' is delimited between the tongue 59' and the strip 52. The transverse end border portions 35 of a series of laterally adjacent floor unit 1 are disposed end to end in the horizontal plane of the floor. To mount this series of laterally adjacent floor units 1 on the girder 51, the border portions 35 and the elongate girder 50 comprise respective first and second mutually mating interlocking means. The first interlocking means comprises the tongue and groove set 38',36' of the border portions 35 while the second interlocking means comprises the tongue and groove set 59',57' of the girder More specifically, the groove 57' receives the tongue 38' while the tongue 59' is received by the groove 36' to thereby align along a straight line the series of laterally adjacent floor units 1 (self-aligning structure) and to allow the girder 51 to support the corresponding end of the modular floor units 1. As the strips 3, 36, 38, 52, 57 and 59 are perpendicular to the horizontal plane of the floor, the first and second interlocking means extend transversely of the floor whereby mutual mating thereof does not only align and support the modular units but prevent these modular floor units 1 from moving with respect to each other in the horizontal plane of the floor (self-interlocking structure). The underneath strips 18 of the units 1 should provide for clearance for the underneath strip 63 of the girder 51 (see FIG. 2).

The other side of the girder 51 is also provided with a narrow longitudinal strip 60 of particle board. More specifically, the strip 60 is secured to the outer face of the strip 54 and to the longitudinal edge surface 61 of the strip 56. As illustrated in FIG. 5, the lower longitudinal edge surface of the strip 60 is coplanar with the underside of the strip 56 and is secured to the top face of the strip 63. A further longitudinal strip 62, wider than strip 60 is superposed to the narrow strip 60 with the lower edge surface of the strip 62 secured to the top face of strip 63.

Again, a longitudinal tongue 62' is formed by the strip 62 and a longitudinal groove 60' is delimited in between the tongue 62' and the strip 54. The tongue and groove set 62',60' is capable of mating with the tongue and groove set 38',36' of the end border portions of a series of laterally adjacent modular floor units 1 as described in the foregoing description with reference to the groove 57' and the tongue 59' of the other side of the girder 51. Again, the underneath strips 18 should provide for clearance for the underneath strip 63 of the girder 51 (see FIG. 2).

The superposed top panels 16 and 17 of the floor units 1 define a sheet to receive a girder crown 110. The girder crown 110 is composed of a lower strip 111 to the top face of which is secured a second slightly wider strip 112 of particle board.

Although a specific example of modular floor unit has been presented in the foregoing description, it should be kept in mind that the tongue and groove of the different longitudinal and transverse border portions of the modular floor unit can be designed as required to receive an adjacent floor unit or an elongate aligning member as required to construct a particular floor structure. For example, when a single series of laterally adjacent floor units 1 is required to erect a floor, the tongue and groove of the transverse border portions of the modular floor units must be designed to receive an elongate aligning member 39 at both ends thereof. In fact, the floor units 1 must be designed to receive elongate aligning members 39 all around the floor being erected.

Figure 7:
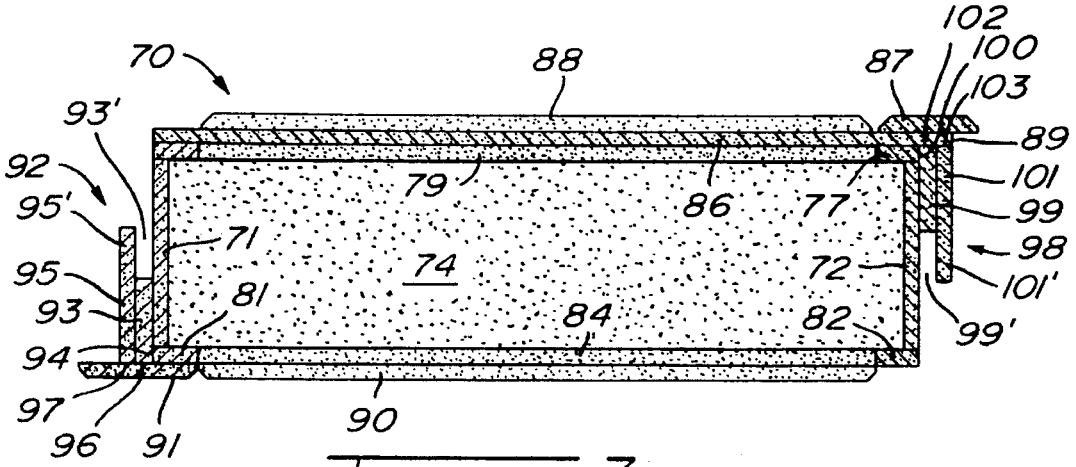
FIG. 7 is a cross sectional elevational view of the modular wall units of the construction kit of FIGS. 1 and 2, taken along a line such as line C—C of FIG. 1.
Figure 6:
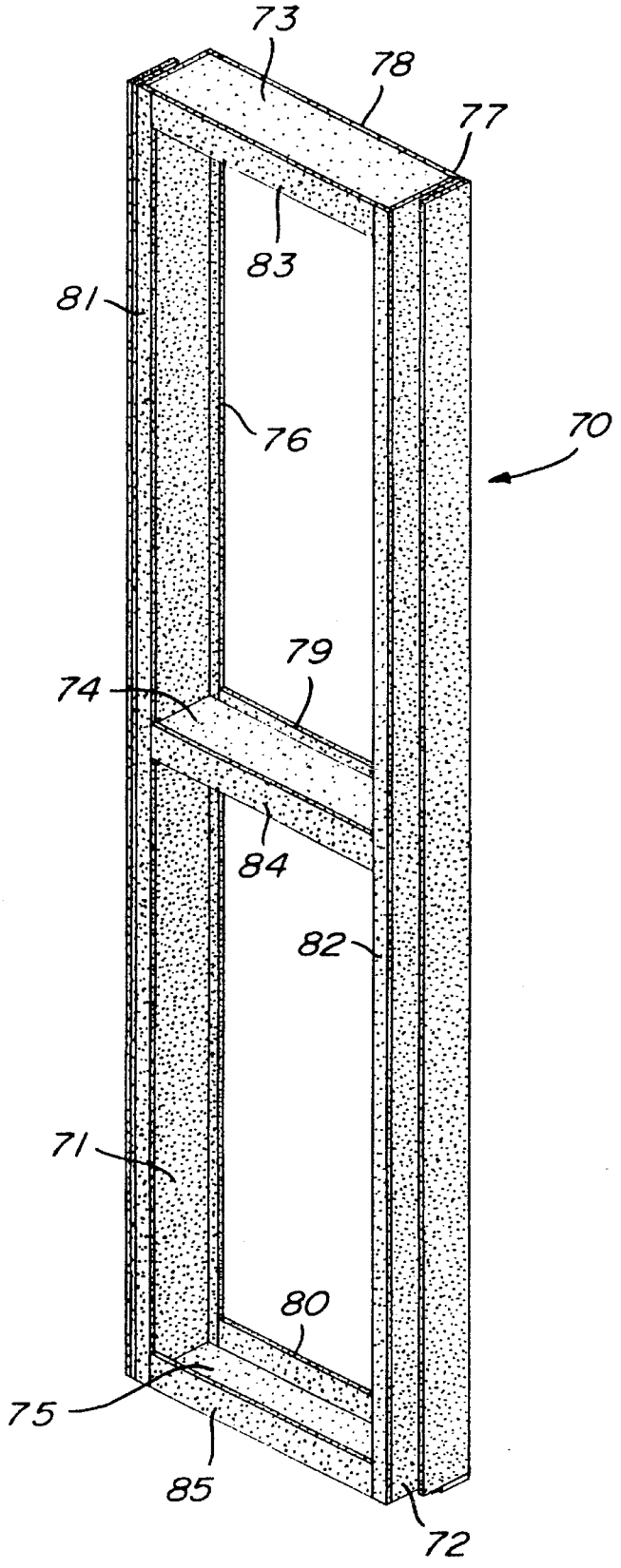
FIG. 6 is a perspective view of the basic framing of a modular wall unit of the construction kit of FIGS. 1 and 2.

The construction kit in accordance with the present invention further comprises elongate modular wall units such as 70, very similar to the modular floor units 1. Each modular wall unit 70 is formed, as illustrated in FIGS. 6 and 7, of two longitudinal strips 71 and 72 of particle board, an upper transverse strip 73 of particle board, a central transverse strip 74 of the same material and a lower transverse strip 75. As can be seen, the strips 71–75 define a rectangular box-like structure.

Secured to the outer edge surfaces of the strips 71–75 are outer longitudinal narrow strips 76 and 77 as well as outer transverse narrow strips 78–80. Secured to the inner edge surfaces of the strips 71–75 are also inner longitudinal narrow strips 81 and 82, and inner transverse narrow strips 83–85, all made of particle board. The function of the outer and inner narrow strips 76–85 is to reinforce the rectangular box-like structure and to provide gluing, nailing and/or screwing surfaces.

A panel 86 (FIGS. 1 and 7) of particle board is mounted on the outer narrow strips 76–80 to form an outer surface of the modular wall unit 70. Fixed on the outer face of the panel 86 of each modular unit 70 is a longitudinal narrow strip 87 and a plurality of transverse narrow strip such as 88, providing for nailing of an exterior wall covering. As shown in FIG. 7, the longitudinal strip 87 is positioned to protrude from the corresponding edge surface 89 of the panel 86.

Further strips such as 90 and 91 (FIG. 7) of particle board may be superposed to the inner narrow strips 81–85 to provide for nailing of the interior wall finishing materials. The inside of the modular wall units 70 is therefore open, for example to enable installation of insulating material, water pipes, electric wires, etc.

Referring now to FIGS. 6 and 7, a first longitudinal border portion 92 of each modular unit 70 comprises a narrow longitudinal strip 93 of particle board fixed to the outer face of the strip 71 and to the outer edge surface 94 of the reinforcing strip 81. Another longitudinal strip 95, wider than the strip 93, is superposed to the strip 93. The edge surfaces 96 and 97 of the strips 93 and 95 are coplanar and fixed to the inner face of the longitudinal strip 91 which protrudes from the outer face of the strip 95 as illustrated in FIG. 7.

The other longitudinal border portion 98 of each modular wall unit 70 comprises a narrow longitudinal strip 99 of particle board fixed to the outer face of the strip 72, and to the outer edge surface 100 of the reinforcing strip 77. Another longitudinal strip 101, wider than strip 99, is fixed to the outer face of this strip 99. The longitudinal edge surfaces 102 and 103 of the strips 99 and 101 are coplanar and fixed to the inner face of the panel 86.

As can be appreciated, a longitudinal tongue 95' is formed by the strip 95 and a longitudinal groove 93' is delimited between the tongue 95' and the strip 71. In the same manner, a longitudinal tongue 101' is formed by the strip 101 and a longitudinal groove 99' delimited in between the tongue 101' and the strip 72. The tongue and groove sets 95',93' and 101',99' form first and second mutually mating interlocking means permitting easy assembly of a series of laterally adjacent wall units 70 (self-interlocking structure); the groove 93' will receive the tongue 101' of an adjacent modular wall unit while the tongue 95' will be received by the groove 99' of this adjacent modular wall unit (see FIG. 8). As the strips 71, 93, 95 and 72, 99, 101 are perpendicular to the vertical plane of the wall, the grooves 93' and 99' and the tongues 95' and 101' connect the modular units 70 to each other in the vertical plane to thereby prevent lateral movement of a series of laterally adjacent modular wall units 70 with respect to each other. Therefore, when a load is applied to one of the modular wall units 70, flexion of this modular unit produces a pulling force on the other modular wall units 1 through the mutually mating tongue and groove sets 95',93' and 101',99' whereby the other modular units 1 will also contribute to support that load and thereby to increase the rigidity and strength of the floor structure (self-resisting structure).

Figure 8:
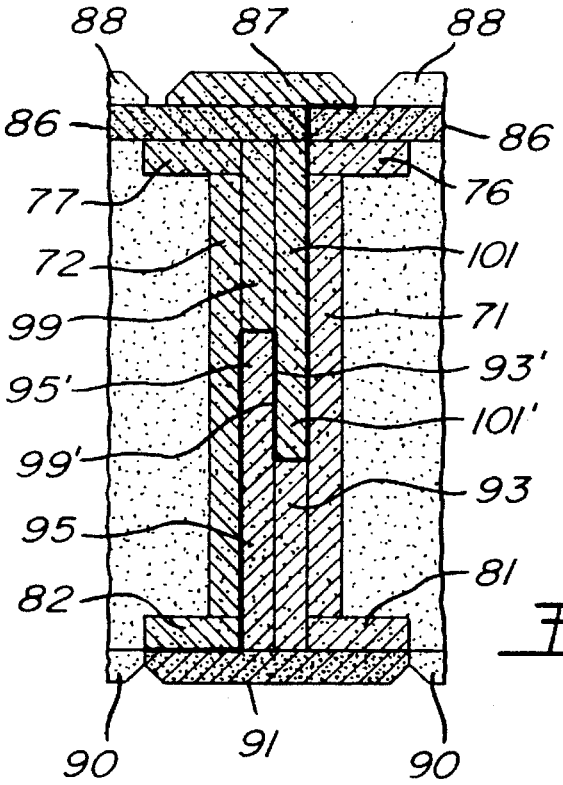
FIG. 8 is a cross sectional elevational view illustrating the method of assembling two laterally adjacent wall units, again taken along a line such as line C—C of FIG. 1.

FIG. 8 shows that the laterally protruding longitudinal strips 87 and 91 of each pair of laterally adjacent wall units 70 contributes to seal the joint between these laterally adjacent units on the two opposite sides of the wall.

Referring back to FIG. 2, the lower end of each modular wall unit 70 comprises a narrow transverse strip 104 of particle board fixed to the underside of the transverse strip 75, and to the bottom edge surface 105 of the lower transverse inner reinforcing strip 85. Another transverse strip 106, wider than strip 104, is fixed to the underside of the strip 104 and to the bottom edge surface 107 of strips such as 90 and 91.

The strips 104 and 106 fit into a gap provided between the strips 46 and 47 of the elongate aligning member 39 and the top floor panel 17. The lower transverse strip 88 protrudes beyond the underside of the unit 70 to rest on the outer edge surface 108 of the strip 47 of elongate member 39. Therefore, the lower end of each modular wall unit 70 snugly fits on the member 39 surrounding the floor structure to align and prevent lateral movement of the lower ends of the laterally adjacent modular wall units 70 (self-aligning and self-interlocking structure). More specifically, this is carried out by a first set of mutually mating tongue (formed by strips 104 and 106) and groove ( formed by the gap between the strips 46 and 47 and the panel 17) and a second set of mutually mating tongue (formed by strips 46 and 47 of member 39) and groove (formed by the gap between the lower strip 88 and the strip 104 and 106). It should be pointed out here that strip 47 is omitted when the floor structure receives no wall units 70. Strip 46 of the elongate member 39 and panels 17 then define a continuous top floor surface.

Figure 9:
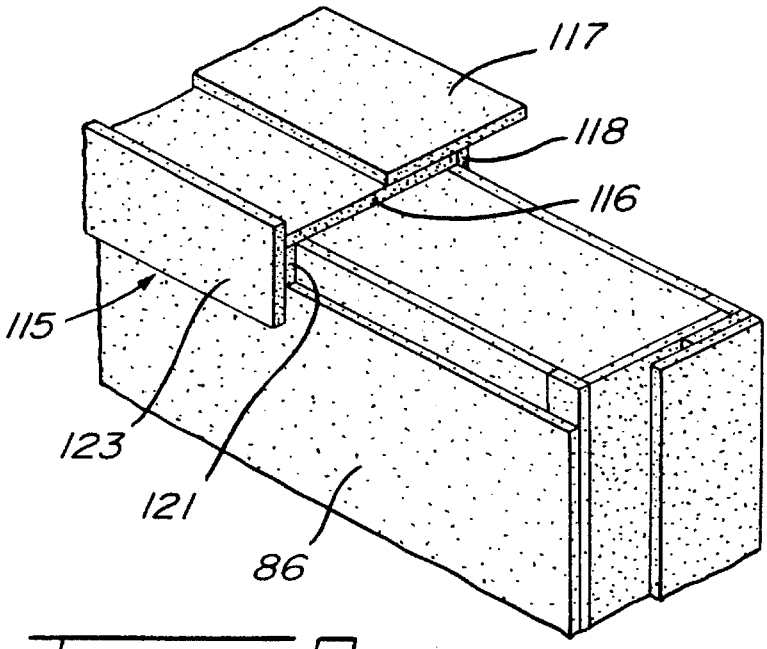
FIG. 9 is a perspective view of an elongate aligning member mounted on the upper end border portion of the laterally adjacent modular wall units.

Finally, an upper elongate aligning member 115 (FIGS. 1, 2 and 9) is mounted on the upper end of the laterally adjacent modular wall units 70. Elongate member 115 is formed of a longitudinal and horizontal strip 116 of particle board. On the top surface of the strip 116 is secured another narrower horizontal strip 117 shifted laterally toward the interior. Strip 118, perpendicular to the strips 116 and 117, is secured to the inner edge surface 119 of the strip 116, and has an upper edge surface 120 fixed to the underside of strip 117. A further strip 123, perpendicular to the strips 116 and 117, has an inner face fixed to the outer longitudinal edge surface 124 of the strip 116. Strip 123 can be used to nail the exterior wall covering. Finally, a narrow strip 121 is fixed to the inner face of the strip 123, and comprises an upper longitudinal edge surface 122 secured to the underside of strip 116.

The elongate aligning member 115 is designed to be positioned on the upper end of the modular wall units 70. The strip 121 fits at the upper end of the panel 86. In the same manner the longitudinal strip 118 fits onto the inner strips such as 90 and 91 (self-interlocking structure). The series of laterally adjacent modular units 70 are thereby aligned (self-aligning structure).

The top face of the member 115 is designed to receive modular floor units 1. It receives the strips 18, 33 and 40 in between the strips 123 and 117, the underneath strips 18 providing for adequate clearance for the strip 117. As the strip 123 protrudes laterally beyond the top and bottom faces of the strip 116, it seals the joints between the wall units 70 and the member 115, and between this member 115 and the floor units 1.

Accordingly, the transverse end border portions 30 of the series of laterally adjacent floor unit 1 comprises on the bottom face of these floor units a tongue (strips 18, 33 and 40) fitting into a groove of the member 115 (between strips 117 and 123), and a groove (gap defined by strips 18) to receive a tongue (strip 117) of the elongate member 115. As can be appreciated by one of ordinary skill in the art, these mutually mating tongue and groove set form first and second interlocking means extending transversely of the modular floor units to thereby aligning along a straight line the series of laterally adjacent floor units 1 in the horizontal plane (self-aligning structure). As the first and second interlocking means extend transversely of the floor, mutual mating thereof does not only align the modular floor units 1 but also prevent these modular floor units 1 from moving with respect to each other in the horizontal plane of the floor (self-interlocking structure). It should be noted here that an elongate aligning member 115 will be mounted on the top of the four walls of the building being erected.

Although this will not be specifically described in the present specification, the above concept can be easily extended to modular units suitable for erecting a roof, foundations, a ceiling, partition walls, etc. In the case of foundations, rot-proof board material should obviously be used to construct the different modular units and aligning members. A suitable material is the cement bonded particle board sold under the name PYROK and manufactured by the company Pyrok North America Inc., 1881 Yonge Street, Suite 600, Toronto, Ontario, Canada.

It should also be mentioned that the different elements (modular floor and wall units, elongated aligning members, etc.) can be nailed or otherwise fastened together upon erection of a building.

Also, the strips of particle board forming the different tongue and groove sets can be formed of a single piece molded or extruded (see for example 170 in FIG. 2).

Although the present invention has been described hereinabove by way of a preferred embodiment thereof, this embodiment can be modified at will, within the scope of the appended claims, without departing from the spirit and nature of the subject invention.

What is claimed is:

1. A kit to be used in the construction of a building, comprising (a) a set of modular units to be assembled laterally adjacent to each other into a given plane to form a wall means, and (b) an elongate aligning member, wherein:

each modular unit comprises a geometrical plane, and first and second elongate opposite border portions;

the first border portion comprises a first longitudinal face generally perpendicular to said -geometrical plane, a first longitudinal tongue generally parallel to the first face, and a first longitudinal groove formed between the first tongue and the first face;

the second border portion comprises a second longitudinal face generally perpendicular to said geometrical plane, a second longitudinal tongue generally parallel to the second face to be inserted in the first groove of an adjacent modular unit, and a second longitudinal groove formed between the second tongue and the second face to receive the first tongue of said adjacent modular unit;

the modular units comprise respective third elongate border portions which are aligned when said modular units are assembled laterally adjacent to each other in the given plane;

the third elongate border portions each comprise a third longitudinal face generally perpendicular to said geometrical-plane of the corresponding modular unit, a third longitudinal tongue generally parallel to the third face, and a third longitudinal groove formed between the third tongue and the third face;

the elongate aligning member comprises a fourth longitudinal face, a fourth longitudinal tongue generally parallel to the fourth face to be inserted in the third grooves of the aligned third border portions, and a fourth longitudinal groove formed between the fourth tongue and the fourth face to receive the third tongues of the aligned third border portions;

whereby, insertion of the fourth tongue in the third grooves and insertion of the third tongues in the fourth groove give to the modular units a given alignment in the given plane and prevent said modular units from moving with respect to each other in said given plane.

2. The construction kit of claim 1, in which:

(a) the first border portion of each modular unit comprises superposed longitudinal strips of board material including (i) a first strip generally parallel to said geometrical plane, (ii) a second strip mounted on said first strip, and (iii) a third strip mounted on the second strip to define the first longitudinal tongue and the first longitudinal groove between said first tongue and said first strip; and (b) the second border portion of each modular unit comprises superposed longitudinal strips of board material including (i) a fourth strip generally parallel to said geometrical plane, (ii) a fifth strip mounted on said fourth strip, and (iii) a sixth strip mounted on said fifth strip to define the second longitudinal tongue and the second longitudinal groove between said second tongue and said fourth strip;

(c) said first, second and third strips form a single piece, and said fourth, fifth and sixth strips form a single piece.

3. The construction kit of claim 1, in which:

(a) the third elongate border portion of each modular unit is formed of superposed longitudinal strips of board material including (i) a first strip generally perpendicular to said geometrical plane, (ii) a second strip mounted on said first strip, and (iii) a third strip mounted on the second strip to define the third longitudinal tongue and the third longitudinal groove between the third tongue and the first strip; and (b) the elongate aligning member is formed of superposed longitudinal strips of board material including (i) a fourth strip, (ii) a fifth strip mounted on said fourth strip, and (iii) a sixth strip mounted on said fifth strip to define the fourth longitudinal tongue to be received by the third grooves and the fourth longitudinal groove between the fourth tongue and the fourth strip to receive the the third tongues.

4. The construction kit of claim 3, wherein said first, second and third strips form a single piece, and wherein said fourth, fifth and sixth strips form a single piece.

5. The construction kit of claim 1, wherein said elongate aligning member is a girder comprising first and second opposite sides and wherein:

(a) the third elongate border portion of each modular unit comprises superposed longitudinal strips of board material including (i) a first strip generally perpendicular to said geometrical plane, (ii) a second strip mounted on said first strip, and (iii) a third strip mounted on the second strip to define the third longitudinal tongue and the third longitudinal groove between the third tongue and the first strip; and (b) on each of said first and second opposite sides of the girder, said girder comprises superposed longitudinal strips of board material including (i) a fourth strip, (ii) a fifth strip mounted on said fourth strip, and (iii) a sixth strip mounted on said fifth strip to define the fourth longitudinal tongue to be received by the third grooves and the fourth longitudinal groove between the fourth tongue and the fourth strip to receive the third tongues.

6. The construction kit of claim 1, wherein:

(a) said set of modular units to be assembled laterally adjacent to each other into the given plane to form a first wall means is a first set of modular units; and (b) said construction kit further comprises a second set of modular units to be assembled laterally adjacent to each other into a second given plane to form a second wall means angularly disposed with respect to said first wall means; wherein:

each modular unit of the second set comprises a second geometrical plane, and fourth and fifth elongate opposite border portions;

the fourth border portion comprises a fifth longitudinal face generally perpendicular to the second geometrical plane, a fifth longitudinal tongue generally parallel to the fifth face, and a fifth longitudinal groove formed between the fifth tongue and the fifth face;

the fifth border portion comprises a sixth longitudinal face generally perpendicular to the second geometrical plane, a sixth longitudinal tongue generally parallel to the sixth face to be inserted in the fifth groove of an adjacent modular unit of the second set, and a sixth longitudinal groove formed between the sixth tongue and the sixth face to receive the fifth tongue of said adjacent modular unit of the second set;

the modular units of the second set further comprise respective sixth elongate border portions which are aligned when said modular units of the second set are assembled laterally adjacent to each other in the second given plane;

the aligned sixth elongate border portions and the elongate alignment member comprise mutually mating tongues and grooves to give to the modular units of the second set a given alignment in the second given plane.

7. The construction kit of claim 6, wherein the aligned sixth border portions have respective grooves, and wherein the elongate aligning member comprises a longitudinal tongue mating said grooves of the sixth border portions.

* * * * *